United States Patent [19]

Wulff

[11] 4,241,667

[45] Dec. 30, 1980

[54] GROUNDED RAILWAY CENTER PLATE LINER

[75] Inventor: Cal W. Wulff, Elmhurst, Ill.

[73] Assignee: Holland Company

[21] Appl. No.: 61,528

[22] Filed: Jul. 27, 1979

[51] Int. Cl.[3] ..... B61F 5/16; B61F 5/50; F16C 17/04; H01R 39/46

[52] U.S. Cl. ..... 105/199 C; 105/189; 308/137; 339/5 P; 339/8 R

[58] Field of Search ..... 105/189, 199 C; 308/137; 339/3 R, 3 S, 5 P, 8 A, 8 R, 47, 217 S

[56] References Cited

U.S. PATENT DOCUMENTS

| | | | |
|---|---|---|---|
| 2,341,360 | 2/1944 | Bulgin | 428/493 |
| 3,037,150 | 5/1962 | Schriner et al. | 361/220 |
| 3,466,102 | 9/1969 | Goodwyn | 308/137 |
| 3,797,862 | 3/1974 | Letterman | 339/5 P X |
| 3,873,886 | 3/1975 | Kato et al. | 361/216 |
| 3,944,298 | 3/1976 | Cannon | 105/199 C X |
| 4,075,951 | 2/1978 | Chierici et al. | 105/199 C |

*Primary Examiner*—Howard Beltran

[57] ABSTRACT

A grounding arrangement for railroad car center plate assembly bowl liners of the all polymeric type in which the liner is equipped with a grounding device formed from a strip of beryllium copper to define a generally U shaped contact spring having a lower attachment grounding leg or leaf that is anchored at one end to the liner floor underside, adjacent to but spaced from the liner central center pin receiving aperture, and that is to be in flush engagement with the bolster bowl floor; the other end of the attachment leg is integral with a bight portion located in the liner aperture in two point abutting relation to the liner rim defining same, on a chord of the aperture, which bight portion is integral with a follower contact grounding leaf or leg that overlies the upper surfacing of the bowl liner floor and is contained within but is free of securement to the bowl liner, with the follower contact grounding leaf being spring biased away from the liner floor to maintain engagement with the body bolster center plate undersurfacing both when the body bolster center plate is in normal operating position within the bolster bowl, and when car body roll is occasioned that will tilt the car body bolster center plate relative to the truck bolster bowl.

15 Claims, 8 Drawing Figures

FIG. 1
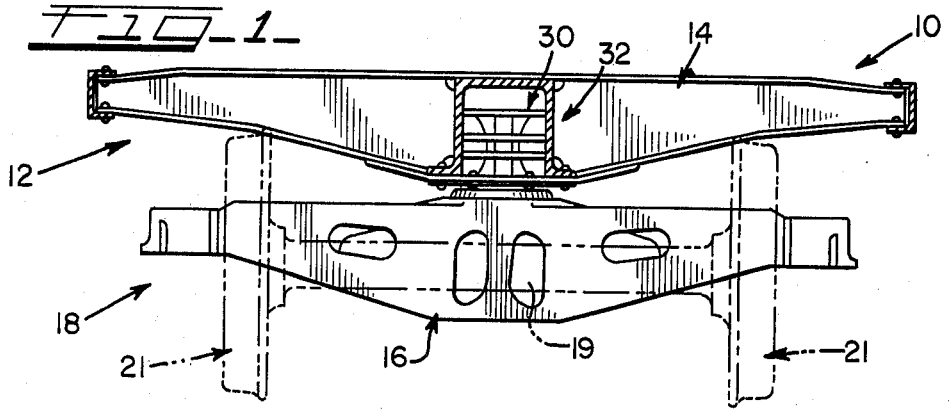
FIG. 2
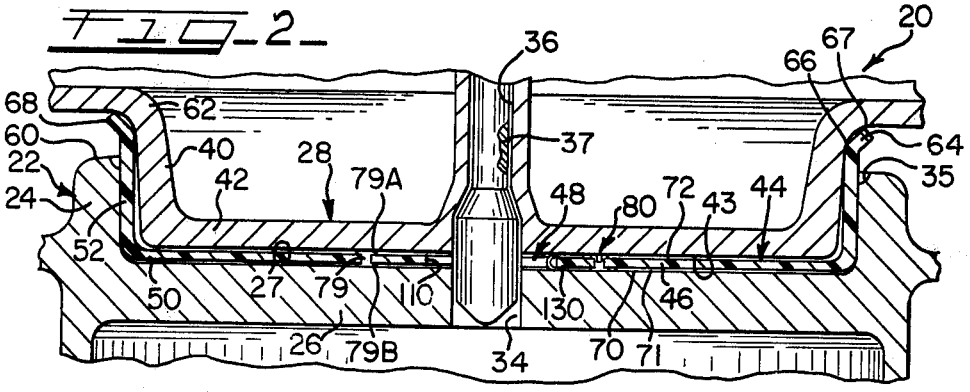
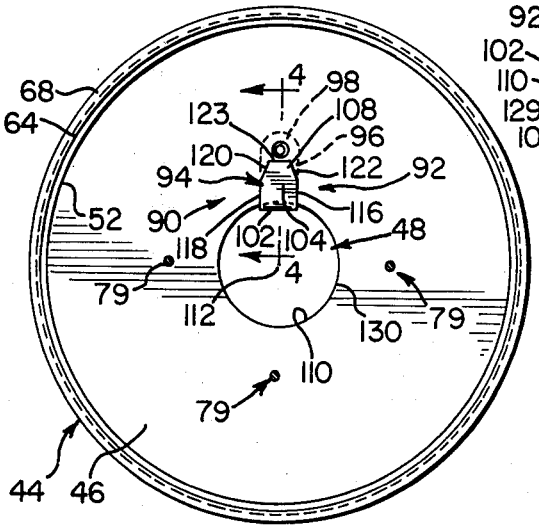
FIG. 3
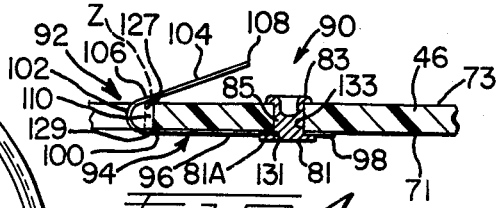
FIG. 4

GROUNDED RAILWAY CENTER PLATE LINER

This invention relates to a grounding arrangement for railroad car center plate assembly bowl liners of the all polymeric type, and more particularly to an arrangement for grounding the car body bolster center plate to the truck bolster bowl through the liner, as where the bowl liner is of the type disclosed in Chierici and Murphy U.S. Pat. No. 4,075,951, granted Feb. 28, 1978.

Railroad cars are commonly in the form of a body resting on and swivelly connected to a pair of trucks adjacent each end of the car. The swivel connection involved in each truck is generally formed by the car body bolster center plate resting on the truck bolster bowl, with these parts being pivotally connected by the well known conventional center pin assembly.

The Chierici and Murphy patent referred to above discloses a special truck bolster bowl liner that was devised to replace the conventional and troublesome manganese steel liner. The Chierici and Murphy liner is in the form of a bowl shaped member or body formed from an ultra high molecular weight polymer of dry self lubricating characteristics. A molecularly oriented polyethylene is preferred, and the bowl member is shaped to define a floor portion and an upstanding side wall portion which is in circumambient relation about the bowl liner floor portion. The bowl liner side wall is proportioned to space the car body bolster center plate from the truck bolster bowl side wall, about the circumference of these components, and hold the body bolster center plate in such spaced relation against end of car imparts, whereby such impact forces transmitted between the car body bolster center plate and the truck bolster bowl side wall are spread over 180 degrees of the bolster components involved thereby avoiding overstressing of these components.

The Chierici and Muphy bowl liner of said patent establishes two slip surfaces in the center plate assembly, one on either side of the bowl liner, that insures adequate truck swivelling action even under severe operating contingencies, and further provides for a wear resisting resurfacing of the bolster surfaces engaged by the bowl liner whereby the center plate assemblies involved become effectively resistant against further wear, as disclosed in said patent.

The bowl liner disclosed in said Chierici and Murphy patent is of all polymeric construction and the polymeric material involved is dielectric or electrically insulating in nature. The preferred material suggested in said patent for making the bowl liner is the molecularly oriented UHMW polyehtylene marketed by Keltrol Enterprises of York, Pennslyvania under the trademark TUFLAR (Grade PL).

The American Association of Railroads requires that railroad car center plate assemblies be arranged so that the body bolster center plate will be sufficiently grounded to the truck bolster bowl so that the center plate assembly will offer no more than about 250 ohms resistance to electrical current flow therethrough. The purpose is to insure that any electric charge that might tend to build up in the car body or be induced in same will be discharged through the car trucks to the track rails. Where the car body center plate acts directly on the bolster bowl, or where the commonly employed manganese steel liner is employed between the two, following prior art practices, the metal to metal contact involved has been considered adequate to meet this AAR requirement, even though the damage problem in the center plate assembly area of the car that is referred to in said Chierici and Murphy patent and was and continued to be, until the advent of said Chierici and Murphy bowl liner, a long standing problem in the railroad field.

Railroad cars having their center plate assemblies equipped in accordance with said Chierici and Murphy patent have the benefits described in said patent. However, as the polymeric material from which the liner is formed is electrically insulating or dielectric in nature, the car body bolster center plate and the truck bolster bowl have been considered to require grounding therebetween even though the bolster center pin may provide a measure of electrical conductivity to the trucks.

The present invention is concerned with providing bowl liners of the type disclosed in said Chierici and Murphy patent with a grounding arrangement whereby the aforeindicated AAR requirement will be conformed to without detracting from the basic utility and effectiveness of said Chierici and Murphy bowl liner as described in said patent.

A principal object of the present invention is to provide a grounding arrangement for railroad car center plate assembly bolster bowl liners that are formed from materials that are normally electrically insulating or dielectric in nature whereby the required grounding action of the body bolster center plate to the bolster bowl operates through the liner.

Another principal object of the invention is to provide a bolster bowl liner grounding arrangement that is part and parcel with the liner, that is arranged to maintain the grounding connection provided between the body bolster center plate and the truck bolster bowl as long as the bowl liner remains part of the center plate assembly, and that is specifically arranged to maintain grounding continuity through any car body roll action experienced by the car so equipped, in service.

Another important object of the invention is to provide a bowl liner grounding contact arrangement that is in the nature of a contact spring having two leaves or legs, one of which seats flush against the underside of the liner for firm contact engagement with the bowl floor, and the other of which is in the nature of a follower or feeler leaf or leg that is spring biased to maintain contact with the body bolster center plate floor underside, even through body roll experienced by the car involved, with the two leaves or legs being intergrally connected through the liner center aperture in such a manner that the center plate assembly center pin causes no interference therewith.

Yet a further important object of the invention is to provide a bowl liner that is made in accordance with said Chierici and Murphy patent in which the bowl liners are each individually equipped with a grounding contact or continuity spring arrangement that does not detract from the fundamental advantages and effective operational results achieved by such bowl liners, that is structurally protected from damage during storage and handling of the liners prior to use and during application to center plate assemblies, as well as removal therefrom, and to provide a grounding arrangement for bowl liners of the type disclosed in said Chierici and Murphy patent that is economical of manufacture, convenient to apply to the liners, that is effective in use, and long lived in operation.

In accordance with the present invention, center plate assembly bowl liners arranged in accordance with the disclosure of said Chierici and Murphy patent have individually applied to the bowl liner floor, adjacent its central kingpin receiving aperture, a grounding spring formed from a strip of a suitable electrically conductive wear resistant material, such as beryllium copper, that includes an attachment grounding leaf or leg affixed flush against the underside of the bowl liner floor for firm face to face engagement with the bolster bowl floor, a follower or feeler contact grounding leaf disposed in operative relation with the upper side of the bowl liner floor, and a bright portion that integrally connects the two leaves together through the bowl liner aperture free of interference with the center pin in the assembled relation of the center plate assembly. The grounding spring leaves are disposed radially of the liner in generally superposed relation, with the attachment leg or leaf being secured to the liner floor at its radially outer end by a single rivet, and with the contact spring strip bight portion being disposed on a chord of the bowl liner central aperture and engaging the liner floor rim forming the aperture, at each side edge of the strip, to provide a firm three point holding action on the grounding spring even though it is physically secured to the liner by a single mounting rivet. The follower or feeler contact leaf or leg in its free standing relation angles upwardly relative to the liner floor radially outwardly of the liner central aperture, at an angle at about 20 degrees, with the contact spring bight portion being struck on a radius that preferably approximates one-half of the thickness of the bowl liner floor; this results in the strip bight portion being protectively disposed within the liner central aperture and shielded against undue compressive stress due to the weight loads supported on the liner floor that would otherwise deform the spring bight portion and detract from the spring biased follower action of the contact spring follower contact leaf on the body bolster center plate underside.

The arrangement is such that when the center plate assembly of which the grounded bowl liner forms a part is subject to normal weight loads, as when the car body involved is applied to the car trucks, and specifically to the car truck bolster bowls, the follower or feeler contact leaf or leg is deflected against the bowl liner floor top surface, with the result that the contact spring bight portion and the follower or feeler contact leaf effect a shifting motion radially outwardly of the liner floor whereby the follower or feeler contact leaf leg in the area of the bowl liner central aperture rim is seated or indented into the liner material itself, at an angulation which nearly approximately its free standing angulation, so that the spring bias of the contact spring follower contact leaf continues to be effective even though the radially outward free end of the follower contact leaf is held flush against the bowl liner floor by the engagement of the car body center plate underside therewith. The attachment contact leaf, of the grounding spring, on the other hand, and the head of the rivet securing same to the liner floor have a width dimension relationship such that a major portion of the attachment contact leaf remains unindented into the liner floor undersurfacing, for maximum area contact, and full contact continuity, with the bolster bowl floor surfacing.

In operation, the contact strip forming the grounding spring maintains full electrical grounding of the car body bolster center plate to the truck bolster bowl through the center plate assembly bowl liner central aperture, with the grounding spring contact leaves maintaining firm grounding engagement with the center plate assembly surfaces they engage. Pivotal movement of the car trucks going around curves and over track crossovers normally results in the swivelling of the truck bolster bowl relative to the bowl liner, which results in the bolster bowl floor swivelling relative to the liner contact strip attachment grounding leaf, which thus has adquate rubbing or scrubbing action on the bolster bowl floor to keep the truck bolster bowl floor area contacted by the grounding spring attached by the leaf adequately free of the resurfacing disclosed in said Chierici and Murphy patent for adequate metal to metal contact electrically conducting purposes.

The follower contact leaf of the grounding spring maintains effective metal to metal contact with the car body bolster center plate floor undersurfacing it engages, both during normal service use, by way of the weight loads acting through the center plate assembly, and during periods when car body roll is experienced; when car body roll is occasioned, the grounding spring follower contact leaf follows the positioning of the car body center plate floor undersurfacing relative to the truck bolster bowl, under the bias built into the contact spring for actuation the follower leaf, which bias is protected and maintained by the special association of the contact spring forming strip with the bowl liner floor that is involved. Occasionally, the bowl liner, due to special circumstances, will remain stationary with the bolster bowl when truck pivoting action occurs, whereby the liner will swivel relative to the car body bolster center plate; under such circumstances, the grounding spring follower contact leaf rides easily across and against the car body bolster center plate undersurfacing involved, for the limited amount of swivelling action that will be experienced (equal to less than the width of the spring), and effecting sufficient scrubbing action on the body bolster center plate undersurfacing engaged thereby to maintain good metal to metal electrically conducting contact.

Other objects, uses, and advantages will become obvious or be apparent from a consideration of the following detailed description and the application drawings, in which like reference numerals indicate like parts throughout the several views.

In the drawings:

FIG.1 is a diagrammatic transverse cross-sectional view through a railroad car body underframe at one of its body bolsters, showing some parts of same and the supporting truck bolster in elevation, with the truck wheels being shown in phantom and the truck side frames omitted for ease of illustration;

FIG. 2 is a fragmental vertical cross-sectional view through the center plate assembly shown in FIG. 1, illustrating on an enlarged scale one embodiment of the center plate assembly components, including the grounding spring equipped self lubricating bowl liner as arranged in accordance with the present invention;

FIG. 3 is a top plan view of the bowl liner, showing same as separated from the center plate assembly and on a reduced scale;

FIG. 4 is a fragmental cross-sectional view, taken substantially along line 4—4 of FIG. 3, but on an enlarged scale and diagrammatically illustrating the bowl liner contact spring arrangement of the invention in its free standing relation, and thus prior to application of the bowl liner to a center plate assembly;

Figure 5:
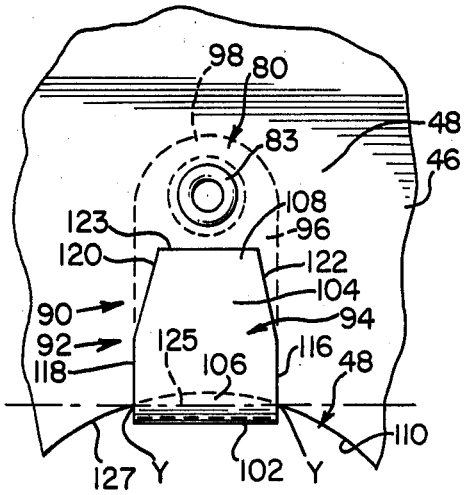
FIG. 5 is a fragmental plan view of the contact spring and associated liner floor as shown in FIG. 3, but on an enlarged scale.
Figure 7:
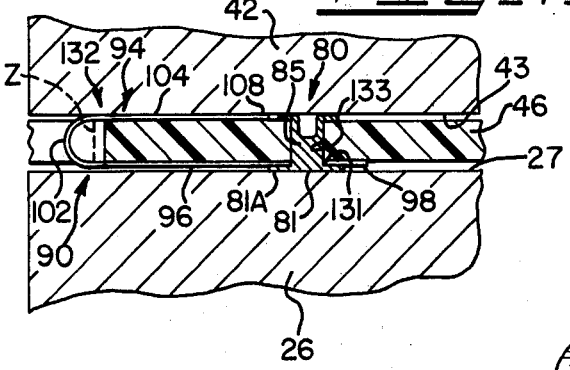
Figure 8:
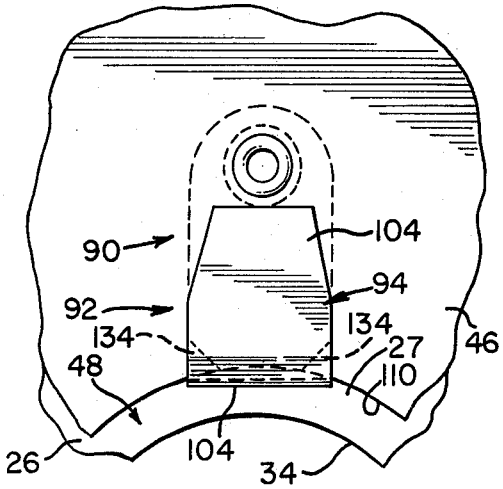

FIG. 7 is a view similar to that of FIG. 4, but showing the bowl liner and associated contact spring as employed in a center plate assembly, and thus FIG. 7 is an enlarged view of the corresponding portions of FIG. 2; and, FIG. 8 is a showing of the contact spring and associated liner floor as viewed in FIG. 5, but illustrating the condition of FIG. 7, and indicating the change of positioning of the contact spring follower leaf that has occurred radially outwardly of the liner floor, as compared to the positioning of FIG. 5.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

Reference numeral 10 generally indicates a railroad car in diagrammatically illustrated form and shown to comprise a car body underframe 12 having a car body bolster 14 resting on and swivelly connected to truck bolster 16 of railroad car truck 18 having the usual axles 19 riding on the usual wheels 21. The conventional truck side frames are not shown to simplify the drawing.

The connection of the car bolster 14 to the truck bolster 16 is effected using center plate assembly 20, which is accordance with the invention of said Chierici and Murphy patent comprises conventional truck bolster bowl 22 (see FIG. 2) that is integral with the truck bolster 16 and defines upstanding side wall 24 and floor 26 having top surfacing 27. The truck bolster bowl 22 receives conventional body bolster center plate 28 that in the form shown is integral with the conventional center filler 30 suitably fixed to the underframe center sill 32 for forming the "center plate" of body bolster 14.

As is conventional, the truck bolster bowl floor 26, and center plate 28 are apertured as indicated at 34 and 36, respectively, to receive the conventional center pin 37 (only a fragment of which is shown) that swivelly connects these two components together. The truck bolster bowl 22 and the car body center plate 28 are of standard shaping, the thus the bolster bowl wall 24 is shown to include the usual recessed edge 35 that normally functions to receive welding material for welding the conventional manganese steel liner to the bowl 22. Edge 35 serves no function in the practice of the invention of said patent, or in the practice of the instant invention, but also does not interfere with the practice of either invention. In practicing the invention of said patent and the instant invention, both the bowl 22 and the center plate 28 may be considered to be free of any preliminary machining and thus may be used as cast or otherwise formed in accordance with accepted manufacturing procedures for such equipment.

The body bolster center plate 28 comprises a depending side wall 40 that is integral with planar wall or foor portion 42 that seats within the bolster bowl 22. The center plate floor portion 42 defines undersurfacing 43 that in accordance with prior art practices rested on the floor surfacing 27 of the bolster bowl when the center plate assembly is assembled. As is well known in the art, the center plate 28 may be a separate component or part of a separate component suitably affixed to the center sill 32 and/or the body bolster 14, or the plate 28 may be an integral part of bolster 14 or parts of same.

Following the disclosure of said Chierici and Murphy patent, the special bowl liner 44 of that patent is interposed between the body bolster center plate 28 and the side wall 24 and floor 26 of the bolster bowl 22. The bowl liner 44 is of dished, bowl-like configuration, and comprises a floor or disc portion 46 of rounded configuration that is centrally apertured as at 48 to receive the aforementioned conventional center pin 37. The liner 44 about the outer margin 50 of its floor or disc portion 46 defines upstanding side wall 52 that is in circumambient relation thereabout and that is continuous and uninterrupted about its circumference, as indicated in FIG. 3.

As disclosed in said patent, the liner 44 is arranged and proportioned such that the liner side wall 52 and the liner floor or disc portion 46 are proportioned to so fill the space between the truck bolster bowl 22 and the body bolster center plate 28 that no lost motion movement of the center plate 28 relative to the bowl 22 in the plane of these components is permitted. Thus, the side wall 52 of the liner 44 is proportioned to fill the space between the truck bolster bowl side wall 24 and the body bolster center plate side wall 40 to the extent that bowl wall 24 holds the liner 44 against movement in the plane of the bowl 22, and liner 44 holds the center plate 28 against movement in the same plane. For this purpose, the bowl liner 44 need not have its inner surfacing along the floor 46 or wall 52 of same fully complement the normal tapered outer surfacing of the center plate 28 at the lower portion of its wall 40. It is only necessary that the liner wall 52 have a thickness such that at the upper level of the bowl wall 24 just below recess 35 the liner wall 52 fully fills the space between the center plate wall 40 and the truck bolster wall 24, so as to preclude movement of the center plate 28, relative to the bowl 22 in the plane of the center plate assembly 20.

As is further specified in said patent, the bowl liner wall 52 does not seat in any way on the top surfacing 60 or its recess 35; in the form illustrated the wall rises straight out of the bowl interior for firm engagement with the neck portion 62 of the center plate wall 40, 360 degrees thereabout, so as to effect a seal about the center plate 28 neck portion 62 that precludes entry of foreign material into between the liner 44 and the center plate 28. In the specific form illustrated, the liner wall 52 is formed with outwardly flared flange 64 that is inclined at approximately 45 degrees with respect to the wall 52, which makes a dual line sealing contact with the center plate neck portion 62, as at 66 and 67. Flange 64 terminates in a dust deflecting edge 68.

Said patent may be referred to for further specifics pertaining to the invention of said patent (the entire disclosure of which is incorporated herein by this reference), though it may be further pointed out that the liner 44 forms a two or dual slip surfacing arrangement in the center plate assembly 20, which insures the needed swivelling action of the car trucks 18 with respect to the car body 12. The normal functioning slip surfacing is that indicated at 70 between the liner 44 and the bolster bowl side wall 24 and floor 26. However, the liner also forms a secondary contingency slip surfacing 72 between the liner 44 and the center plate floor 42 and side wall 40 of the body bolster center plate 28. The liner 44 is in no way bonded to either the truck bolster bowl 22 or the body bolster center plate 28. When the truck bolster swivels with respect to the car body in following the track, the swivelling action is normally at the slip surfacing 70, with the liner 44 thus remaining stationary with respect to the body bolster center plate 28. However, should the liner 44 due to special circumstances during train operation become so clamped between the bolster side wall 24 and the body bolster center plate side wall 40 that the needed swivelling action does not occur at the slip surfacing 70, the swivelling action does occur at the contingency slip surfacing 72, with the liner 44 then remaining stationary with the truck bolster bowl under the contingency circumstances indicated.

The bowl liner 44 of said patent is of one piece construction formed from said polymer material, which is essentially dielectric or electrically insulating in character. In order to comply with the aforementioned AAR requirement as to maximum ohm resistance through the center plate assembly 20, it has been proposed to equip liners of this type with a number of rivets 79 of any suitable type applied thereto in spaced apart relation thereabout (several are shown in FIG. 3 for illustrative purposes), and formed from a suitable electrically conductive material of wear resisting characteristics such as brass. Rivets 79 serve no holding function as such, but are intended to serve as electrically conductive contacts between the car body center plate 28 and the bolster bowl 22 when the center plate assembly 20 is assembled in operative relation.

Experience has indicated that the rivets 79, as such, are not a satisfactory answer to the indicated AAR requirement, as in use the compressive forces acting on the liner floor or disc portion 46 tend to indent the ends of the rivets within the upper and lower levels of the bowl liner floor 46, as represented by the liner floor undersurfacing 71 and the liner floor top surfacing 73 due to the fact that the rivets 79 are columnarilly compressed under the compressive forces involved, from either end of the respective rivets, to the extent that the rivet ends (head end or clinched end), or one of them, may be even pressed below or within the respective liner top and bottom floor surface levels indicated by the bowl liner floor surfaces 71 and 73. The result is that one or more of the thus deformed rivets 79 will represent a severing or breaking of the desired electrical conduit path between the center plate 28 and the bolster bowl 22, whereby a bowl liner equipped with the rivets 79, by themselves, may not meet the indicated AAR maximum ohm resistance requirement for center plate assembly. Of course, when body roll occurs, the center plate 28 will likely go completely out of contact with rivets 79 as the roll cycle proceeds.

The present invention is directed to providing a grounding arrangement or device 90 which includes a grounding spring 92 in combination with a rivet 80 and the bowl liner floor 46. The arrangement involved is more specifically illustrated in FIGS. 3–8 wherein it will be seen that the grounding spring 92 comprises a strip 94 of a suitable electrically conductive metallic material, such as beryllium copper, that comprises an attachment grounding leaf or leg 96 that is secured flush against the underside surface 71 of the bowl liner floor 46 by the indicated rivet 80 of FIGS 3–8 adjacent one end 98 of the leaf 96, with the other end 100 of the leaf 96 being integral with a bight portion 102 that is located in the bowl liner center aperture 48. Bight portion 102 is integral with upwardly angled follower contact grounding leaf or leg 104, at the end 106 of leaf 104; the other end 108 of the leaf 104 is free of connection with the bowl liner 44, and in the free standing condition of the spring 92, the leaf 104 is upwardly angled relative to the liner floor 46 at a flat angle that preferably is approximately 20 degrees (see FIG. 4).

As indicated in FIGS. 3 and 5–8, the strip 94 extends radially of the liner 44, and is disposed adjacent the rim wall 110 of the liner that defines the central aperture 48. In a preferred embodiment, the rivet 80 of device 90 is positioned at a spacing of approximately six inches from the axial center 112 of the liner floor 46, as this locates the spring leaves 96 and 104 at an area of minimum compressive stress loading conditions in the assembled relation of the center plate assembly 20 while disposing the spring leaves 96 and 104 at positions relative to the bolster bowl floor 27 and body bolster center plate undersurfacing 43 where maximum contact surfacing will be assured 360 degrees about axial center 112.

The strip 94 is preferably formed from the BERYLCO 165HM mill hardened beryllium copper stripping product made and sold by Kawecki Berylco Industries, Inc. of Reading, Pennsylvania. A thickness of 0.012 inch is preferred for providing adequate flexibility and resistance to deformation while avoiding undue stiffness and thickness that could limit the self adjustability of the device and complicate the assembly of parts.

As indicated in FIGS. 3, 5, 6 and 8, the strip 94 has opposite side edges 116 and 118 that are in parallelism, with the end 98 of the leaf 96 being of rounded configuration struck on an arc that generally complements that of the rivet 80 that cooperates therewith. The end 108 of the leaf 104 is of tapered configuration, as defined by the spaced apart diagonal and coverging edge portions 120 and 122 that terminate in rectilinear end edge portion 123 that extends transversely of strip 94. The tapered end portion 108 of the follower contact leaf 104 is thus shaped for a constant bending stress section under the compressive forces that will be involved when the center plate assembly 20 is assembled as indicated in FIGS. 2 and 7, to insure long life.

The bight portion 102 of the strip 94 is of special significance, as is the angulation of the follower contact arm or leaf 104. The strip bight portion 102 is struck about a radius that is approximately one-half of the thickness of the bowl liner floor 46 (in terms of the range specified below), but which substantially exceeds the minimum bending radius of the strip 94, which for the 0.012 thickness is 0.072 inch. As a matter of preferred practice, it is recommended that the radius of bight portion 102 be equal to one-half of the thickness of bowl liner floor 46, but the bight portion radius may somewhat exceed one-half the bowl liner floor thickness with some benefit, as explained below. Thus, assuming, as in a commerical form of bowl 44, that the thickness of the bowl liner floor 46 is one-quarter inch, the radius that the bight portion 102 is struck about should be one-eighth of an inch; such radius should in any event be in the range of from one-eighth of an inch to five-thirty seconds of an inch. For liner floors having thickness other than one-quarter inch, the radius of bight portion 102 should be varied in direct proportion.

While having the bight portion radius equal to one-half the bowl liner floor thickness is preferred as a guide, when the radius in question exceeds the bowl liner thickness within the range indicated, on assembly of the center plate assembly the bight portion 102 is contracted somewhat and at the same time extends toward axis 112 of the liner floor 46, but well short of engagement with the centerpin 37. Thus, automatic take up of the indicated excess bight portion circumferential length is provided for. Further, the bight portion radius range indicated permits the spring 92 to self adjust to slight tolerance variations in the bowl liner floor thickness dimension.

The bight portion 102 of spring 92 is thus proportioned to lie wholly within the central aperture 48 of the liner floor 46, whereby the bight portion 102 is shielded from overstressing under the compressive loads applied to the liner floor 46 by the center plate 28 resting on the bolster bowl floor 26 through liner floor 46, thereby avoiding overstressing of the bight portion that could deform the spring 92 at this location to the extent that the upwardly acting biasing action of the follower leaf 104 that is desired by the practice of this invention would be adversely affected.

Another important feature of the invention is that the spring 92 and its shaping, and the proportioning of the strip 94 is such that the bight portion 102 in the free standing relation of device 90, lies along a chord 125 of the liner center aperture 48 and engages the lower edge 129 of the liner floor rim 110 (at the bight portion 102), as at X, where the strip side edges 116 and 118 are disposed about the bight portion 102; end 106 of follower leaf 104 similarly engages the upper rim edge 127 at the strip side edges 116 and 118, as at Y. This provides a firm three position holding action on the spring 92 against displacement relative to liner 44 even though the spring 92 is secured to the liner in its operative relation by a single rivet 80. For orientation purposes, in the showings of FIGS. 4 and 7 the contact points X and Y are located by broken line Z.

A further important feature of the invention is that the spring attachment leaf 96 is secured to the liner 46 in such a manner that a substantial degree of contact of the leaf 96 with the bolster bowl floor surface 27 will be maintained in spite of any extremes of compressive stress that the liner floor is subjected to in the area of the spring 92. For this purpose, it has been found that if the width of the leaf 96 has a dimension that is approximately twice the diameter of the head end 81 of rivet 80, in the form that the rivet 80 is applied to the liner floor 46, adequate portions of both the rivet head end 81 and the spring leaf 96 will remain projecting from the level of the liner floor undersurface 71 to insure the metal to metal electrically conductive contact between the spring 92 and the bolster bowl floor that is desired.

Rivet 80 in the preferred embodiment is of the semi-tubular type, formed from either regular or cartridge brass, and having head end 81, clinched end 83, and shank 85, with the rivet head end 81 engaging leaf 96 of spring 92 and clinched end 83 being shaped to be formed, annularly, over against liner surface 73 employing conventional riveting procedures. The rivet head end 81 defines circular head 81A that has a diameter approximating one-half the width of strip 94, in accordance with the strip width, and rivet head end proportioning stated above. The rivet 80 extends through apertures 131 and 133 (see FIGS. 4 and 7) formed in the strip end 98 and liner floor 46 for that purpose. The rivet 80 that is illustrated is the semi-tubular rivet made and sold by Chicago Rivet and Machine Co. of Bellwood, Illinois, with the head 81A being either of the countersunk or flat type.

As has been indicated, in this connection, in practice it has been found that the ends 79A and 79B of the rivets 79 (which can be any conventional type of rivet, and rivets 80 have been tried for use as rivets 79) are deflected toward each other and tend to become indented below or within the surfaces 71 and 73 of the bolster bowl floor 46 under compressive forces applied thereto when the center plate assembly is assembled and in operation. This is the result of both the deformability of the rivets 79 and the tendency of the polymer material from which the bowl liner 44 is formed to flow or displace somewhat to one side of the rivet ends 79A and 79B, and thus become indented in the area of the respective rivet ends 79A and 79B. A similar indenting of the strip leaf 96 into the liner floor 46 is of course to be avoided since the contact continuity at this area of spring 92 could thereby be lost for the same reason.

It has been found that, as indicated, where the width of the spring leaf 96 is approximately twice the external diameter of the head 81A of rivet 80, even though there may be some minor indenting of the leaf 96 into the liner undersurfacing 71 in service, a sufficient combination of the rivet head 81, which will also be flattened somewhat from the showing of FIG. 4, and the remaining area of the downwardly facing surface of the leaf 96, will remain projecting below the level of the liner undersurface 71 to provide adequate contact continuity at this area of the grounding arrangement 90. This proportion of the parts also seems to insure that there is sufficient area of engagement of the upwardly facing surface of the contact leaf 96 with the liner undersurfacing 71 that aids in assuring prevention of over indenting of the contact leaf 96 into the liner floor 46.

It has been found that by forming strip 94 to have a nominal one inch maximum width not only disposes the spring bight portion 102, when in its mounted relation against the liner rim 110, well spaced from center pin 37 (and thus free from damaging engagement thereby), but also the strip 94 will have more than adequate cross-sectional area to provide the electrical conductivity required to meet the indicated AAR requirements. Also, the indicated width dimension seems to provide an optimum compromise between wider widths that could result in angling outwardly of the strip edges 116 and 118 of leaf 96 on application of the rivet 80 (to secure the parts together), that could result in damage to the spring 92 in use, and narrow widths that would unduly indent the strip leaf end 98 into the liner on application of the rivet, with the risk of ultimate contact interruption.

Thus, since the strip 94 has a one inch width, the head 81A of the rivet 80 that is part of contact device 90 should have a diameter approximating one-half inch.

Another feature of the invention is that when the center plate assembly 20 is assembled, assuming the liner 44 with the contact arrangement 90 is applied thereto, when the center plate 28 is applied to the bolster bowl 22 to achieve the relative positioning of parts shown in FIGS. 7 and 8, the follower contact leaf 104, adjacent its end 106, will be indented into the upper edge 127 of rim 110 of the liner 44 adjacent margin 130 of floor 46, where indicated at 132 in FIG. 7. This forms in the liner floor upper surface 73 at the marginal portion 130 a pair of indented, upwardly angled bearing surfaces 134 underlying end 106 of leaf 104 that holds the portion of the leaf 104 overlying same at an angulation that is somewhat reduced from that shown in FIG. 4, but which closely approximates same, as indicated in FIG. 7. The remainder of the outwardly projecting portion of the leaf 104 will be deflected into flush engagement with the bolster floor surface 73, as indicated in FIG. 7.

Figure 6:
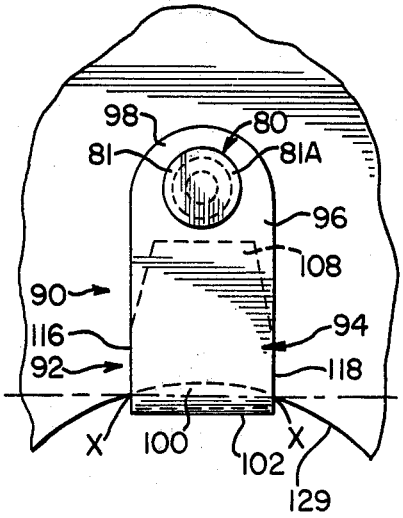
FIG. 6 is a bottom plan view of the contact spring and associated liner floor, on the same scale as FIG. 5.

The formation of the bearing surfaces 134 is the result of the engagement of the strip side edges 116 and 118 with the upper edge 127 of liner floor 46 in the free standing relation of device 90, and a shifting action that occurs on the spring bight portion 102 and leaf 104, that moves same to the right of FIG. 4, radially of liner floor 46, which moves bight portion 102 and leaf 104 from the relative position of FIGS. 4–6 to the position of FIGS. 7 and 8, relative to the liner aperture 48 and rivet 80. What appears to happen is that, as the car body center plate surface 43 engages spring leaf 104, when the center plate assembly 20 is assembled, bight portion 102 and leaf 104 swing clockwise of FIG. 4, about an axis along the plane of chord 125, located approximately where end 100 of leaf 96 merges into bight portion 102, thereby moving the portion of the strip 94 at the juncture of bight portion 102 and end 106 of leaf 104, to thereby seat leaf end 106 into indented relation with liner surface 73 adjacent edge 127 as leaf 104 shifts to the position of FIGS. 7 and 8. Thus, device 90 has built into same a lost motion relation radially of liner floor 46 that is effective on assembly of assembly 20 to form the leaf supporting and positioning bearing surfaces 134. This lost motion relation also provides for accommodation for tolerance variations in the liner floor thickness.

The free standing positioning of the contact spring leaf 104 and its bight portion 102, and the positioning of these parts that is taken when the center plate assembly is assembled, provides the follower contact leaf 104 with an upwardly acting bias that always remains available to maintain the leaf 104 in proper metal to metal contact engagement with the undersurfacing 43 of the center plate 28. This is especially important when body roll of the car is experienced, since such body roll will result in the center plate 28 tilting relative to the bolster bowl 22 and thus the bowl liner 44. As the portion of the center plate 28 that is engaged by the spring leaf 104 moves away from the contact spring 92, as roll is experienced, the contact spring leaf 104 due to the biasing action built into same, as preserved by the protected location of the spring bight portion 102 and the indented bearing surfaces 134, follows and maintains its contact with the center plate undersurface 43.

This following action of spring leaf 104 is partially due to the tendency of the free end portion 108 of the spring leaf 104 to return to its upwardly angled relation of FIG. 4 as center plate 28 moves upwardly of assembly 20, but it is also due to the presence of the indented surfacings 134 in the liner floor that are formed in supporting relation to the leaf 104 adjacent its end 106, where indicated at 132, on either side of the center line of strip 94, in liner rim portion 130, by the assembly of the center plate assembly. This aids in preserving the arced configuration of the bight portion 102 against undue deformation and holds the portion 106 of leaf 104 to position the leaf end portion 108 for maximum metal to metal contact effectiveness with the center plate undersurfacing 43 as separation between the center plate 28 occurs and disappears under the body roll action involved.

During operation of the center plate assembly 20, the liner 44 functions in the manner described in said Chierici and Murphy patent to provide the advantages therein described. This includes the resurfacing of the bolster bowl surfaces involved in the slip surfacing 70 and the center plate surfaces involved in the slip surfacing 72. As already indicated, the swivelling action at the center plate assemblies 20 normally occurs at the slip surface 70, with the swivelling action normally being a maximum of about 8 degrees in either direction, about the central axis of the center pin 37 and the center plate assembly 20. This amounts dimensionally to a movement of about 0.42 inch in either direction at the radial location of rivet 80. The presence of the spring attachment leaf 96, and its projection below the level of the liner surface 71 effects a sufficient scrubbing action on the bowl floor surfacing 27 of the bolster bowl, in the area where the contact spring 92 is located to keep that area of the bolster floor surfacing 27 adequately clear of the indicated resurfacing to maintain good metal to metal contact between the spring 92 and the bowl floor surface 27. Further, since the strip is one inch in width, some portion of the bowl floor surface 27 underlying spring leaf 96, extending longitudinally of leaf 96, will be entirely free of the resurfacing as long as liner 44 does not move relative to center pin 37. The rounded nature of the end 98 of leaf 96 avoids undesirable gouging of the bolster bowl floor 27 as this swivelling action occurs.

Where the swivelling occurs at the slip surfacing 72, the side edges of the spring leaf 104 effect a similar scrubbing action on the undersurfacing 43 of the center plate 28 for the same purpose. The angled nature of the diagonally disposed edges 120 of the leaf end portion 108 facilitate the center plate undersurface scrubbing action involved. Again, some portion of the center plate lower surfacing 43 that overlies spring leaf 104 will be free of this resurfacing, due to the width of strip 94.

The arrangement of the liner 44 as equipped with the contact arrangement 90 mounts the follower contact leaf 104 in protected relation within the bowl liner 44, and specifically within the confines of its side wall 52. Thus, bowl liners 44 equipped as indicated may be readily stacked, handled, or even thrown or passed around in the manner of a frisbee without damaging the contact leaf 104 or deforming it from its relative position shown in FIG. 4.

In accordance with the present invention, the rivet 80 is not relied upon to provide the desired electrical contact continuity between the centerplate 20 and the bolster bowl 22. The rivet 80 employed as part of the contact arrangement 90 has the indicated function of securement of the spring 92 to the liner floor 46, as well as the cooperation with the spring leaf 96 for insuring that the spring leaf 96 remains sufficiently exposed above the bottom level of the liner floor, as represented by undersurfacing 71, to maintain the desired contact continuity at this area of the center plate assembly. The indicated functioning of the contact leaf 104 provides the desired contact continuity at the area of the center plate assembly where it functions.

The other three rivets 79 that are indicated in FIG. 3 are shown merely as representing a contact approach that has been suggested for bowl liners made of materials that are essentially dielectric or electrically non-conductive in nature; in such an arrangement, device 90 would be lacking and a rivet 79 would be applied at the location of rivet 80.

In a preferred specific embodiment, the strip 94 is three and one-quarter inches in length, and in being shaped in conformity with the showings of FIGS. 3–8, spring leaf 96 is one and three-eighths inches long, measuring along its longitudinal axis between end 98 thereof and its juncture with bight portion 102. The strip is one inch in width. Contact leaf 104 has a length along its longitudinal axis of one and one-eighth inches between its juncture with bight portion 102 and its end 108. The leaf end 108 at rectilinear edge 123 measures ⅝ths inch and edges 120 and 122 measure 11/16ths of an inch, and their angulation relative to the longitudinal axis of the leaf 104 is such as to reduce the one inch width dimension of the leaf 104 by ⅜ths of an inch at edge 123.

In forming the spring 92 it is essential that both leaves 96 and 104 be essentially flat or planar in configuration.

The 20 degree angulation of the leaf 104 is believed to be the optimum angulation as any significant additional angulation would invite overstressing of the spring leaf 104 and bight portion 102 in use. Any significant less angulation would invite contact discontinuity during periods of significant body roll activity.

It is also important that the length of the leaf 104 relative to leaf 96 be such that the end 108 of the leaf 94 be short of the position of the end 83 of rivet 80, so that when the center plate 20 is assembled, the edge 122 of the leaf 104 will be free of contact with rivet end 83 to avoid damaging of the rivet 80 and leaf 104. Thus, the indicated lost motion of the spring bight portion 102 and leaf 104 must be short of that which would bring leaf end 108 into engagement with end 83 of rivet 80.

In the showing of FIGS. 2, 4 and 7, such spacing that is shown between the center plate undersurfacing 43 and the bolster bowl floor 27 and the corresponding surfaces 73 and 71 of the liner is provided for facilitating the illustration of the arrangement of device 90. In practice, the center plate undersurface 43 will rest firmly on the liner floor surface 73, while the liner floor surface 71 will rest firmly on the bolster bowl surface 27, as will be understood by those skilled in the art.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In a liner formed from a dielectric self lubricating polymer material for application in its operative position between a body bolster center plate and a truck bolster bowl of a railroad car center plate assembly that pivotally connects the car body to the car truck, with the bolster bowl having a floor for supporting the center plate and a side wall in circumambient relation of the bowl floor, the body bolster center plate having a floor that is supported by the bolster bowl floor and a side wall in circumambient relation to the body bolster center plate floor, and the liner being of bowl configuration and defining a floor, on which the body bolster center plate floor is to rest, in the operative position of the liner, an upstanding side wall in circumambient relation about the liner floor that separates the bolster bowl side wall from the body bolster center plate side wall, and an aperture at the axial center of the liner floor for receiving the truck centerpin that pivotally connects the body bolster center plate to the bolster bowl with the liner interposed therebetween, for pivotally connecting the car body to the car truck, an arrangement for grounding the body bolster center plate to the bolster bowl through the liner, said arrangement comprising a grounding spring formed from a strip of electrically conductive material and comprising:

an attachment providing leaf on the underside of the liner floor and fixed adjacent one end of same to the liner flush against the bottom surface of the liner floor adjacent to but spaced from the liner central aperture, said attachment leaf extending radially of the liner with the other end of same projecting toward the axial center of the liner and beyond the rim of the liner floor that defines the liner aperture, said grounding spring further including a bight portion disposed in the liner aperture, and a follower contact grounding leaf extending radially of the liner over the top surface of the liner floor in overlying relation to the liner floor and said attachment leaf thereunder, said bight portion being proportioned transversely of said leaves to engage the liner aperture defining rim at the side edges of the strip and having a radius that approximates one half the thickness of the liner floor, said follower contact leaf being integral with said bight portion at one end thereof, and having its other end free of securement to said liner, said follower contact leaf in its free standing relation relative to the liner floor having a flat acute angulation relative to the liner floor with said other end thereof diverging from the liner floor radially outwardly of the liner floor, whereby when said liner is in its said operative position, said attachment leaf is in flush contact with the floor of the bolster bowl, and said contact leaf is pressed by the body bolster center plate floor flush against the liner bowl floor top surface radially outwardly of the liner aperture rim, said follower contact leaf at and adjacent said liner rim being indented into the liner by the compressive forces of the body bolster center plate floor acting on said contact leaf at an acute angle relative to the liner floor top surface whereby said contact leaf is maintained in biased engagement with the body bolster center plate floor for following movement of the body bolster center plate relative to the bolster bowl on car body roll relative to the car truck.

2. The arrangement set forth in claim 1 wherein:

said grounding spring is anchored to the liner by rivet means for riveting said attachment leaf one end to the liner floor, said contact leaf other end extending adjacent to but short of said rivet means.

3. The arrangement set forth in claim 2 wherein:

said rivet means is positioned approximately six inches from the liner axial center, and said rivet means comprises a single rivet having the head end of same engaging said attachment leaf, said rivet head end defining a head that overlaps said attachment leaf.

4. The arrangement set forth in claim 3 wherein:

said attachment leaf has a width that approximates twice the diameter of said rivet head.

5. The arrangement set forth in claim 4 wherein:

said one end of said attachment leaf is rounded to substantially complement said rivet means.

6. The arrangement set forth in claim 1 wherein:

said follower contact leaf other end is of tapered configuration terminating in a terminal edge that extends transversely of said contact leaf.

7. The arrangement set forth in claim 1 wherein:
said bight portion lies on a chord of the liner aperture.

8. The arrangement set forth in claim 1 wherein:
said attachment leaf width and the diameter of said rivet means at the end thereof that overlaps said attachment leaf having a ratio of approximately two to one, whereby the attachment leaf is restrained from full indentation within the liner floor under compressive stressing acting on the liner in the operative position of same.

9. The arrangement set forth in claim 1 wherein:
said grounding spring bight portion and said follower contact leaf are disposed to have limited lost motion radially outward of the liner floor for seating said follower contact leaf against the liner rim for effecting said indenting into the liner.

10. In a railroad car center plate assembly including a liner formed from a dielectric self lubricating polymer material and disposed in its operative position between a body bolster center plate and a truck bolster bowl, with the bolster bowl having a floor for supporting the center plate and a side wall in circumambient relation to the bowl floor, the body bolster center plate having a floor that is supported by the bolster bowl floor and a side wall in circumambient relation to the body bolster center plate floor, and the liner being of bowl configuration and defining a floor, in which the body bolster center plate floor rests, an upstanding side wall in circumambient relation about the liner floor that separates the bolster bowl side wall from the body bolster center plate side wall, and an aperture at the axial center of the liner floor for receiving the truck centerpin that pivotally connects the body bolster center plate to the bolster bowl with the liner interposed therebetween, for pivotally connecting the car body to the car truck, an arrangement for grounding the body bolster center plate to the bolster bowl through the liner, said arrangement comprising a grounding spring formed from a strip of electrically conductive material and comprising:

an attachment grounding leaf on the underside of the liner floor and fixed adjacent one end of same to the liner flush against the bottom surface of the liner floor adjacent to but spaced from the liner central aperture, said attachment leaf extending radially of the liner with the other end of same projecting toward the axial center of the liner and beyond the rim of the liner floor that defines the liner aperture, said grounding spring further including a bight portion disposed in the liner aperture spaced from the kingpin, and a follower contact grounding leaf extending radially of the liner over the top surface of the liner floor in overlying relation to the liner floor and said attachment leaf thereunder, said bight portion being proportioned transversely of said leaves to engage the liner aperture defining rim at the side edges of the strip and having a radius that approximates one half the thickness of the liner floor, said follower contact leaf being integral with said bight portion at one end thereof, and having its other end free of securement to said liner, said follower contact leaf adjacent said bight portion being seated into the liner rim at a flat angle relation relative to the liner floor, with the other end thereof being held flush against the liner floor by the body bolster center plate while being spring biased against same by said bight portion and the portion of said liner underlying said contact leaf indented portion, whereby said attachment leaf is in flush contact with the floor of the bolster bowl, and said follower contact leaf is pressed by the body bolster center plate floor flush against the liner bowl floor top surface radially outwardly of the liner aperture rim, said follower contact leaf being maintained in biased engagement with the body bolster center plate floor for following movement of the body bolster center plate relative to the bolster bowl on car body roll relative to the car truck.

11. The arrangement set forth in claim 10 wherein:
said grounding spring is anchored to the liner by rivet means for riveting said attachment leaf one end to the liner floor,
said contact leaf other end extending adjacent to but short of said rivet means.

12. The arrangement set forth in claim 11 wherein:
said rivet means is positioned approximately six inches from the liner axial center.

13. The arrangement set forth in claim 12 wherein:
said rivet means comprises a rivet having its head end engaging said attachment leaf,
said rivet head end defining a head overlapping said attachment leaf,
said attachment leaf having a width that approximates twice the diameter of said rivet head.

14. The arrangement set forth in claim 10 wherein:
said bight portion lies on a chord of the liner aperture.

15. The arrangement set forth in claim 10 wherein:
said attachment leaf width and the diameter of said rivet means head engaging same have a ratio of approximately two to one, whereby the attachment leaf is restrained from full indentation within the liner floor under compressive stressing acting on the liner in the operative position of same.

* * * * *